US008750555B2

(12) United States Patent
Suzuki et al.

(10) Patent No.: US 8,750,555 B2
(45) Date of Patent: Jun. 10, 2014

(54) SPEAKER APPARATUS

(75) Inventors: Nobukazu Suzuki, Kanagawa (JP); Yoshio Ohashi, Kanagawa (JP)

(73) Assignee: Sony Corporation (JP)

( * ) Notice: Subject to any disclaimer, the term of this patent is extended or adjusted under 35 U.S.C. 154(b) by 279 days.

(21) Appl. No.: 13/283,971

(22) Filed: Oct. 28, 2011

(65) Prior Publication Data

US 2012/0114150 A1 May 10, 2012

(30) Foreign Application Priority Data

Nov. 9, 2010 (JP) ..... P2010-251271

(51) Int. Cl.
*H04R 25/00* (2006.01)
*H04R 1/00* (2006.01)

(52) U.S. Cl.
USPC ..... 381/431; 381/190

(58) Field of Classification Search
USPC ..... 381/190, 431; 181/147, 163, 164, 167
See application file for complete search history.

(56) References Cited

U.S. PATENT DOCUMENTS 6,522,760 B2 * 2/2003 Azima et al. ..... 381/431
7,194,098 B2 * 3/2007 Azima et al. ..... 381/431
2007/0133837 A1 6/2007 Suzuki et al.

FOREIGN PATENT DOCUMENTS

JP 2007-166027 A 6/2007

* cited by examiner

*Primary Examiner* — Brian Ensey
(74) *Attorney, Agent, or Firm* — Lerner, David, Littenberg, Krumholz & Mentlik, LLP

(57) ABSTRACT

A speaker apparatus includes: an actuator serving as a source of vibration; a vibration transmitting member connected to the actuator; and two sheet-like diaphragms provided opposite to each other in the thickness direction thereof with the vibration transmitting member and disposed in contact with the vibration transmitting member, wherein vibration generated at the actuator is transmitted to each of the two diaphragms through the vibration transmitting member to output sounds.

14 Claims, 8 Drawing Sheets

SPEAKER APPARATUS

CROSS-REFERENCE TO RELATED APPLICATION

The present application claims priority from Japanese Patent Application No. JP 2010-251271 filed in the Japanese Patent Office on Nov. 9, 2010, the entire content of which is incorporated herein by reference.

FIELD

The present disclosure relates to the field of techniques associated with speaker apparatus. More particularly, the present disclosure relates to the field of techniques for transmitting vibration generated at an actuator to two diaphragms disposed opposite to each other with a vibration transmitting member interposed between them to provide a speaker having an improved sound pressure while keeping the thickness of the speaker small.

BACKGROUND

There are speaker apparatus from which sounds are output by transmitting vibration generated at an actuator to a diaphragm through a vibration transmitting member. For example, the actuator used in such a manner may be a piezoelectric actuator, an electrostrictive actuator or the like. A material having high vibration transmitting characteristics may be used as the vibration transmitting member, and the diaphragm may be formed from, for example, a resin material such as an acrylic material.

In a speaker apparatus as thus described, when vibration generated at the actuator is transmitted to the diaphragm through the vibration transmitting member, a compressional wave is instantaneously propagated in the direction in which the vibration is transmitted (vibration exciting direction). During the propagation of the compressional wave, a force attributable to the Poisson's ratio of the solid body (diaphragm) is generated in a direction orthogonal to the vibration exciting direction. When the force in the direction orthogonal to the vibration exciting direction is generated, the force causes the diaphragm to vibrate, and sound waves are generated throughout the diaphragm to output sounds.

Therefore, in a speaker apparatus utilizing a vibration transmitting member and a diaphragm as thus described, sound waves are generated at a level that is uniform in any part of the diaphragm, and uniform acoustic characteristics can be achieved throughout the diaphragm.

Speaker apparatus of the above-described type include a speaker having an actuator disposed on one side of a cylindrical diaphragm when viewed in the axial direction of the diaphragm and a vibration transmitting member disposed in contact with one end face of the diaphragm when viewed in the axial direction of the diaphragm. Thus, vibration is transmitted to the end face of the diaphragm in the axial direction thereof to output sounds from the diaphragm (see JP-A-2007-166027 (Patent Document 1)).

In the speaker apparatus disclosed in Patent Document 1, when vibration is transmitted to the vibration transmitting member, a compressional wave is instantaneously propagated in the axial direction of the diaphragm. A force attributable to the Poisson's ratio of the diaphragm is generated in a direction orthogonal to the axial direction of the diaphragm to cause vibration of the diaphragm. Thus, sound waves are generated throughout the diaphragm, and sounds are output.

SUMMARY

The speaker apparatus disclosed in Patent Document 1 has a problem in that it is difficult to provide the apparatus with a small thickness because a cylindrical diaphragm is used.

In order to achieve a high sound pressure with the speaker apparatus disclosed in Patent Document 1, the number of the diaphragm and the vibration transmitting member must be increased. As a result, the size of the apparatus increases, and it becomes more difficult to provide the apparatus with a small thickness.

Under the circumstance, it is desirable to provide a speaker apparatus having an improved sound pressure while keeping the thickness of the apparatus small by solving the above-described problem.

An embodiment of the present disclosure is directed to a speaker apparatus including an actuator serving as a source of vibration, a vibration transmitting member connected to the actuator, and two sheet-like diaphragms provided opposite to each other in the thickness direction thereof with the vibration transmitting member and disposed in contact with the vibration transmitting member. Vibration generated at the actuator is transmitted to each of the two diaphragms through the vibration transmitting member to output sounds.

In the speaker apparatus, the vibration generated at the actuator is simultaneously transmitted to the two diaphragms disposed opposite to each other with the vibration transmitting member interposes between them.

The vibration transmitting member of the speaker apparatus is preferably a wire extending in a direction orthogonal to the thickness direction of the diaphragms, and each of the two diaphragms is preferably in contact with a circumferential surface of the vibration transmitting member.

The vibration transmitting member is a wire extending in a direction orthogonal to the thickness direction of the diaphragms, and each of the two diaphragms is in contact with a circumferential surface of the vibration transmitting member. Thus, the diaphragms contact the vibration transmitting member over a great contact area.

In the speaker apparatus, a peripheral part of each of the two diaphragms is preferably in contact with the vibration transmitting member.

Since a peripheral part of each of the two diaphragms is in contact with the vibration transmitting member, the diaphragms can be stably located with respect to the vibration transmitting member.

The speaker apparatus preferably includes a plurality of the actuators, and two actuators among the plurality of the actuators are preferably disposed on two sides of the diaphragms.

Since the two actuators are disposed on two sides of the diaphragms, high space utilization can be achieved in the regions of the diaphragms where the actuators are disposed.

The two diaphragms of the speaker apparatus are preferably formed from different materials.

The two diaphragms can be made to output sounds in different audio bands by forming the two diaphragms from different materials.

The two diaphragms of the speaker apparatus are preferably formed with different thicknesses.

The two diaphragms can be made to output sounds in different audio bands by forming the two diaphragms with different thicknesses.

At least either of the two diaphragms of the speaker apparatus is preferably formed from a transparent material.

When some device is disposed between the diaphragms, the device can be viewed from outside the apparatus if at least either of the two diaphragms of the speaker apparatus is formed from a transparent material.

In the speaker apparatus, a display device displaying images or a light source device emitting light is preferably disposed between the two diaphragms.

Sounds can be generated along with another type of output by disposing a display device displaying images or a light source device emitting light between the two diaphragms.

In the speaker apparatus, the vibration transmitting member is preferably provided in the form of a frame extending along peripheral parts of the two diaphragms, and the two diaphragms are preferably attached to the vibration transmitting member and held by the vibration transmitting member.

The vibration transmitting member is provided in the form of a frame extending along peripheral parts of the two diaphragms, and the two diaphragms are attached to the vibration transmitting member and held by the same. Thus, the vibration transmitting member serves as holding means for holding the diaphragms.

In the speaker apparatus, a piezoelectric actuator is preferably used as the actuator.

When a piezoelectric actuator is used, the actuator can be provided with high power.

In the speaker apparatus, a magnetostrictive actuator is preferably used as the actuator.

When a magnetostrictive actuator is used, the actuator can be provided with high power.

In the speaker apparatus, an electrodynamic actuator is preferably used as the actuator.

When an electrodynamic actuator is used, the actuator can be provided with high power.

The speaker apparatus according to the embodiment of the present disclosure includes the actuator serving as a source of vibration, the vibration transmitting member connected to the actuator, and two sheet-like diaphragms provided opposite to each other in the thickness direction thereof with the vibration transmitting member and disposed in contact with the vibration transmitting member. Vibration generated at the actuator is transmitted to each of the two diaphragms through the vibration transmitting member to output sounds.

Since the two sheet-like diaphragms are disposed opposite to each other with the vibration transmitting member interposed between them, a high sound pressure can be obtained with the thickness of the apparatus kept small.

As described above, the vibration transmitting member of the speaker apparatus may be a wire extending in a direction orthogonal to the thickness direction of the diaphragms, and each of the two diaphragms may be in contact with a circumferential surface of the vibration transmitting member.

Sounds can be generated throughout the diaphragms with the configuration of the apparatus kept simple.

As described above, a peripheral part of each of the two diaphragms may be in contact with the vibration transmitting member.

Thus, the diaphragms can be stably located with respect to the vibration transmitting member.

As described above, a plurality of the actuators may be provided, and two actuators among the plurality of the actuators may be disposed on two sides of the diaphragms.

Thus, a high sound pressure can be obtained while achieving high space utilization in the regions of the diaphragms where the actuators are disposed.

As described above, the two diaphragms of the speaker apparatus may be formed from different materials.

Thus, the two diaphragms can be made to output sounds in different audio bands, and the frequency band of sounds from the speaker apparatus can be made wider.

As described above, the two diaphragms may be formed with different thicknesses.

Thus, the two diaphragms can be made to output sounds in different audio bands, and the frequency band of sounds from the speaker apparatus can be made wider.

As described above, at least either of the two diaphragms may be formed from a transparent material.

As a result, a device providing output other than sounds, e.g., images or light can be disposed between the diaphragms, and the apparatus can be used in a wider range of applications.

As described above, a display device displaying images or a light source device emitting light may be disposed between the two diaphragms.

Thus, the apparatus can be used as a display apparatus outputting images or an illumination apparatus outputting light.

As described above, the vibration transmitting member may be provided in the form of a frame extending along peripheral parts of the two diaphragms, and the two diaphragms may be attached to the vibration transmitting member and held by the vibration transmitting member.

Thus, sheet-like diaphragms having a small thickness can be used to provide the apparatus with a smaller thickness.

As described above, a piezoelectric actuator may be used as the actuator.

Since a piezoelectric actuator generates a great stress, the actuator can be provided with a small size and high power.

As described above, a magnetostrictive actuator may be used as the actuator.

Thus, the actuator can be provided with a small size and high power.

As described above, an electrodynamic actuator may be used as the actuator.

Thus, the actuator can be provided with high power at a low cost.

DETAILED DESCRIPTION

An embodiment of the speaker apparatus according to the present disclosure will now be described with reference to the drawings.

The following embodiment of the present disclosure is directed to a speaker apparatus including a vibration transmitting member and two sheet-like diaphragms disposed opposite to each other with the vibration transmitting member interposed between them. In the following description, upward, downward, frontward, rearward, leftward, and rightward directions with respect to the diaphragms are defined based on an assumption that the directions toward which the diaphragms face (the thickness direction of the apparatus) constitutes the "frontward and rearward directions".

The upward, downward, frontward, rearward, leftward, and rightward directions mentioned below are used for the convenience of description only, and the implementation of the disclosed technique is not limited to such directions.

[General Configuration]

Figure 1:
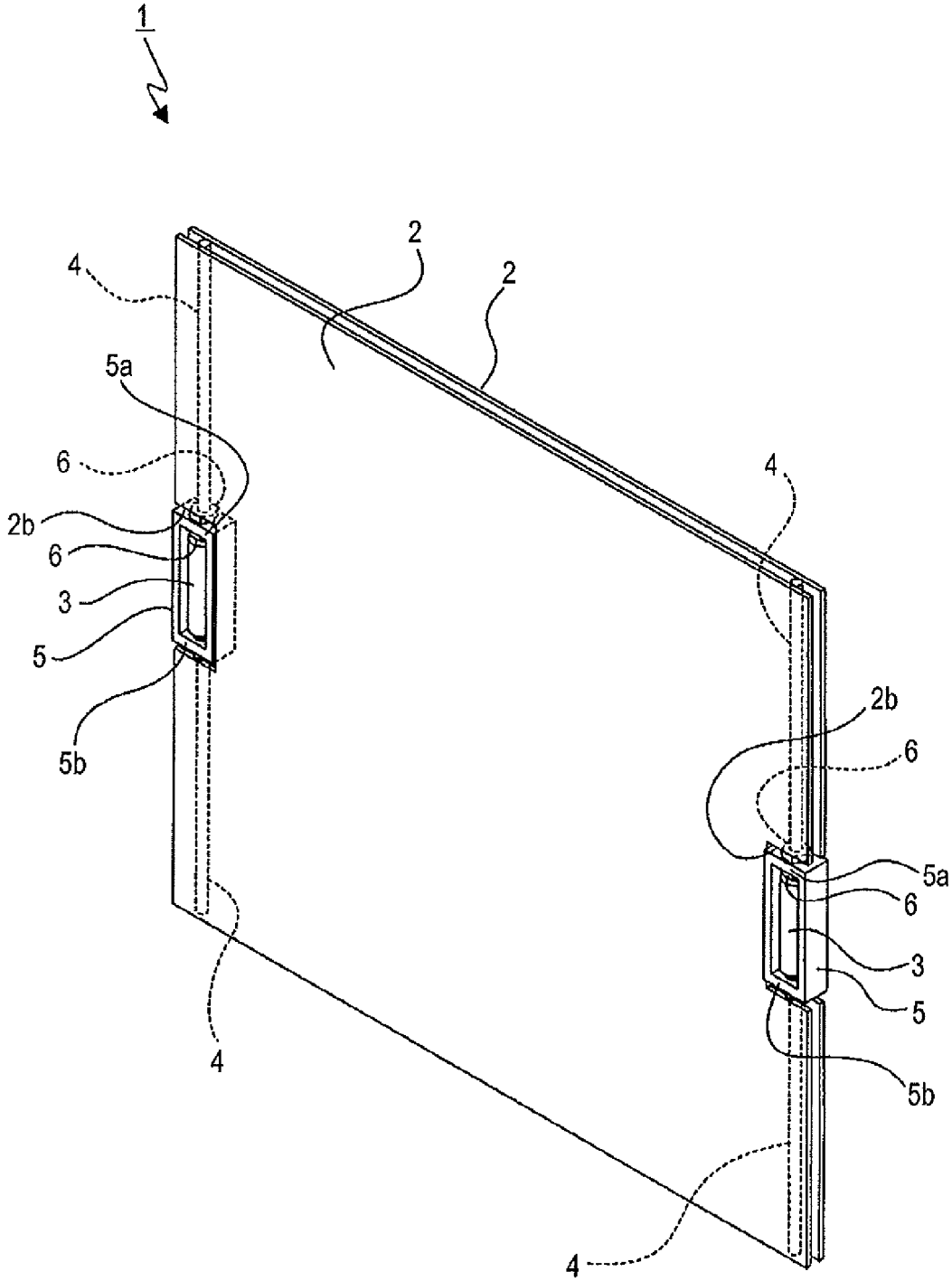
FIG. 1 is a perspective view of a speaker apparatus according to an embodiment of the present disclosure.
Figure 2:
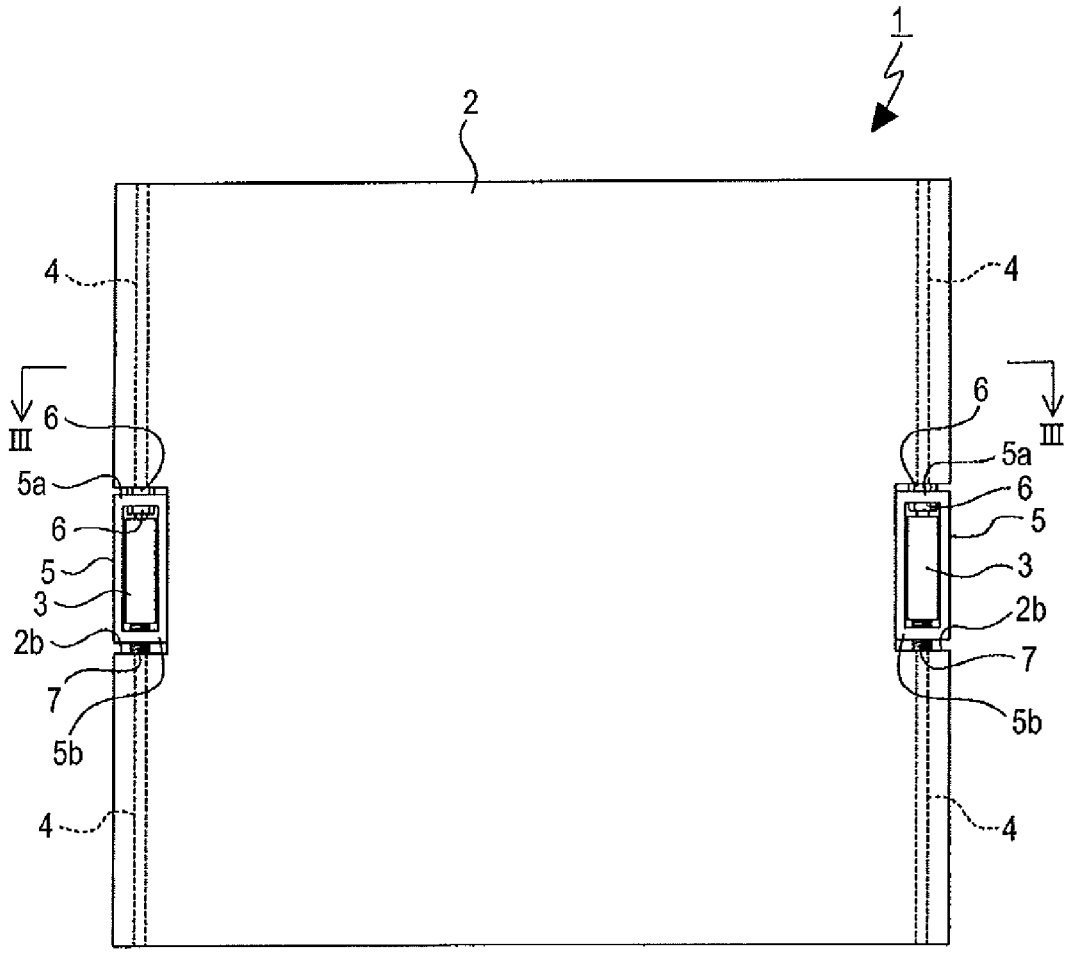
FIG. 2 is a front view of the speaker apparatus.
Figure 3:
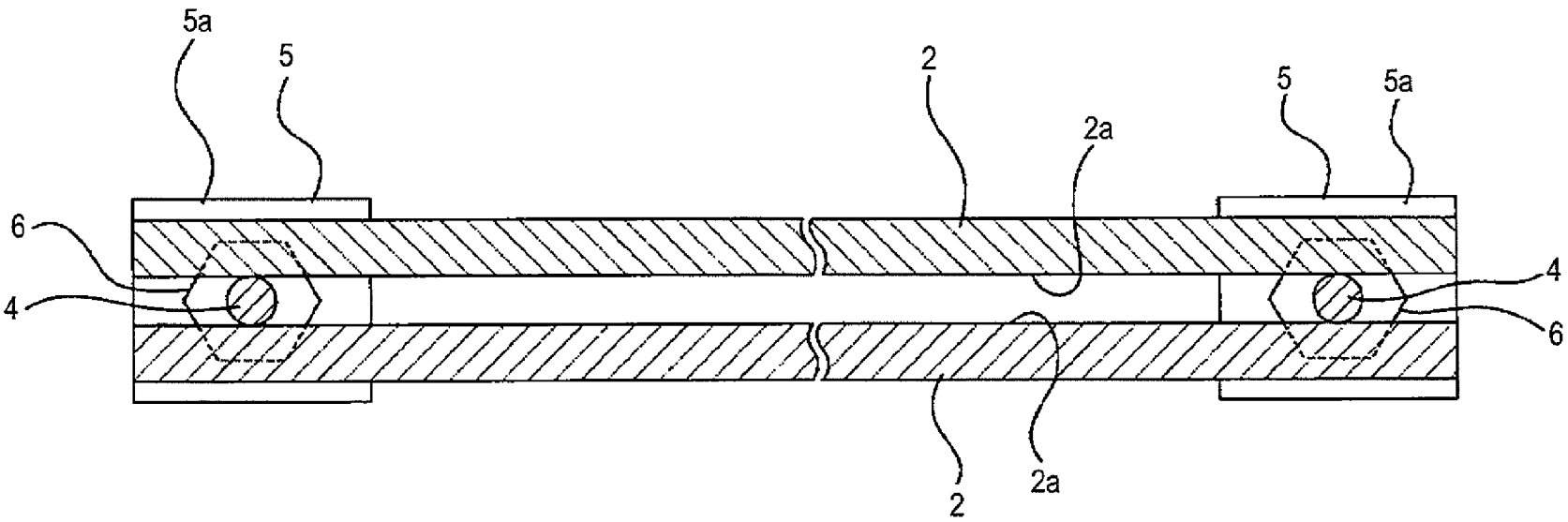
FIG. 3 is a sectional view of the speaker apparatus taken along the line III-III in FIG. 2.

A speaker apparatus 1 includes diaphragms 2, actuators 3, and vibration transmitting members 4 (see FIGS. 1 to 3).

The diaphragms 2 are disposed such that they are opposite to each other when viewed in the front-rear direction of the apparatus, and the sides of the diaphragms facing each other are formed as opposite surfaces 2*a*. For example, the diaphragms 2 are formed in a substantially rectangular shape from a resin material such as an acrylic resin having a thickness of 0.3 mm. The diaphragms have outwardly open locating cutouts 2*b* provided on left and right sides thereof. The diaphragms 2 may alternatively have locating holes formed to extend through the diaphragms in the front-rear direction thereof instead of the locating cutouts 2*b*.

Holders 5 are attached to each of the diaphragms 2 by disposing them in the locating cutouts 2*b* or locating holes. The holders 5 are in the form of rectangular frames having through holes extending in the front-rear direction of the diaphragms.

The actuators 3 are held by respective holders 5. For example, piezoelectric actuators having a multi-layer piezoelectric element are used as the actuators 3. The actuators 3 are disposed in the holders 5 and are formed in a vertically elongate shape, and the longitudinal direction of the actuators is the direction in which vibration occurs.

The actuators 3 are connected to a power supply circuit through connection cables which are not shown, and the actuators 3 are energized and driven by the power supply circuit to cause vibration.

For example, the vibration transmitting members 4 may be music wires which are wires formed from carbon fiber to extend in the top-bottom direction of the diaphragms. The vibration transmitting members 4 are connected to top and bottom ends of the respective actuators 3. For example, the vibration transmitting members 4 have a diameter of about 1.5 mm.

Figure 4:
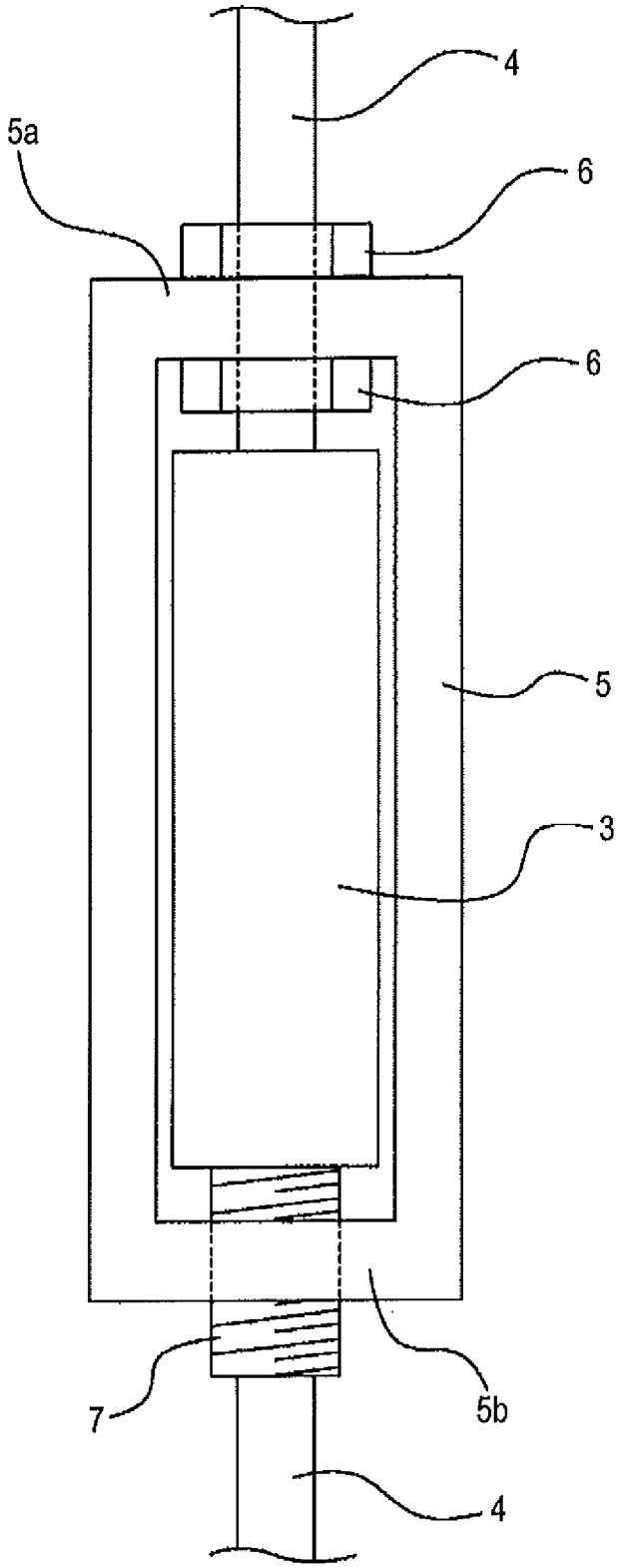
FIG. 4 is an enlarged front view of an actuator.

A bottom end of each vibration transmitting member 4 located on the top side of a diaphragm is connected to the top end of the actuator 3 associated therewith, and a part of the member near the bottom end thereof penetrates through a top end portion 5*a* of the holder 5 (see FIG. 4). The part of the top side vibration transmitting member 4 near the bottom end thereof is secured to the top end portion 5*a* of the holder 5 with nuts 6.

A top end of each vibration transmitting member 4 located on the bottom side of a diaphragm is connected to the bottom end of the actuator 3 associated therewith, and a part of the member near the top end thereof penetrates through a bottom end portion 5*b* of the holder 5.

An urging screw 7 is engaged with the bottom end portion 5*b* of the holder 5. A top end of the urging screw 7 is made to contact a bottom surface of the actuator 3 from underneath the actuator, and the screw is screwed into the bottom end portion 5*b* of the holder 5 and is consequently displaced upward. Thus, the screw has the function of pressing the bottom surface of the actuator 3 from underneath the same to urge the actuator 3 in the direction of compressing the actuator. A pre-load is imparted to the actuator 3 by the urging screw 7 to improve the reliability of operations of the actuator 3 associated with the generation of vibration and to achieve improved acoustic characteristics consequently.

A compression coil spring (not shown) may be disposed inside the urging screw 7, and a ball or pin (not shown) to be urged upward by the compression coil spring may be disposed at the top end of the urging screw 7. The ball or pin can be displaced upward or downward with respect to the urging spring 7. The use of an urging spring 7 having such a configuration allows an urging force of the compression coil spring to be imparted to the actuator 3 through the ball or pin, whereby the actuator 3 can be urged in the direction of compressing the same.

Left and right ends of the two opposite surfaces 2*a* of the diaphragms 2 are in contact with circumferential surfaces of the respective vibration transmitting members 4, and the diaphragms 2 are attached to the vibration transmitting members 4 by using, for example, a bonding process. In this case, the surface roughness of the parts of the opposite surfaces 2*a* of the diaphragms 2 in contact with the vibration transmitting members 4 may be increased to improve the bonding strength of the adhesive.

The vibration transmitting members 4 may be partially or entirely embedded in the diaphragms 2 as long as vibration can be transmitted to both diaphragms 2. All of the actuators 3, the vibration transmitting members 4, and the holders 5 may be embedded in the diaphragms 2. In this case, for example, so-called insert molding may be carried out. That is, the elements including the vibration transmitting members 4 may be disposed in cavities of a metal mold, and the cavities may be filled with a molten resin to mold the diaphragms integrally with the elements.

When the actuators 3 are piezoelectric actuators including a multi-layer piezoelectric element, since stress generated by the piezoelectric actuators is as great as several hundred Newtons, no problem occurs in the operation of the diaphragms 2 even if the actuators 3 are embedded in the diaphragms 2.

When the holders 5 are embedded in the diaphragms 2, it is desirable to form the holders 5 from the same material as the diaphragms 2 to achieve a satisfactory state of bonding between the holders and the diaphragms.

[Operation of Speaker Apparatus]

The operation of the speaker apparatus 1 will now be described.

When the actuators 3 of the speaker apparatus 1 is energized to generate vibration, the vibration thus generated is transmitted to the vibration transmitting members 4, and a compressional wave is instantaneously propagated. During the propagation of the compressional wave, a force attributable to the Poisson's ratio of the diaphragms 2 is generated at the diaphragms 2 in a direction (left-right direction) orthogonal to the propagating direction of the vibration of the vibration transmitting members 4. The diaphragms 2 are vibrated by the force, and sound waves are generated throughout the diaphragms 2 to output sounds.

At this time, sound waves are generated in the speaker apparatus 1 at a level that is uniform in any part of the diaphragms 2, and uniform acoustic characteristics can be achieved throughout the diaphragms 2.

[Outline of the Description]

As described above, the speaker apparatus 1 includes the two sheet-like diaphragms 2 disposed opposite to each other with vibration transmitting members 4 interposed between them, and the apparatus is configured such that vibration generated at the actuators 3 is transmitted to the diaphragms 2 through the vibration transmitting members 4 to output sounds.

Since the apparatus has a configuration in which the two sheet-like diaphragms 2 are disposed opposite to each other with the vibration transmitting members 4 interposed between them, an improved sound pressure can be obtained with the thickness of the apparatus kept small. In particular, since the vibration transmitting members 4 are disposed to serve the diaphragms 2 commonly, there is no need for providing dedicated vibration transmitting members 4 to serve the diaphragms 2, respectively. The simple configuration allows the apparatus to be provided with a smaller number of components and a smaller thickness when compared to apparatus in the related art.

The vibration transmitting members 4 are in the form of wires extending in the top-bottom direction of the apparatus, and the diaphragms 2 are in contact with circumferential surfaces of the respective vibration transmitting members 4. Therefore, sound waves can be generated throughout the diaphragms 2 although a simple configuration is used.

Further, since the apparatus has a structure in which peripheral parts of the diaphragms 2 are in contact with the vibration transmitting members 4, the diaphragms 2 can be attached to the vibration transmitting members 4 in a stable manner.

In addition, the two actuators 3 of the speaker apparatus 1 are disposed on the left and right sides of the diaphragms 2, respectively. Therefore, an improved sound pressure can be achieved while achieving high space utilization in the regions of the diaphragms 2 where the actuators 3 are disposed.

The speaker apparatus 1 includes two diaphragms 2, and the two diaphragms 2 may be formed from different materials or with different thicknesses. Sounds in different bands can be output from the two diaphragms 2 by forming the two diaphragms 2 from different materials or with different thicknesses. Thus, sounds in a wider frequency band can be output from the speaker apparatus 1.

Resin materials other than acrylic resins which can be used as the material of the diaphragms 2 include, for example, ABS (acrylonitrile butadiene styrene) copolymer. The diaphragms 2 may be made different from each other in terms of frequency characteristics by forming the diaphragms with different thicknesses, and a great frequency range can be obtained by the combination of the different thicknesses.

[Other Configurations of the Speaker Apparatus]

Other configurations of a speaker apparatus according to the present disclosure will now be described (see FIGS. 5 to 8).

Figure 5:
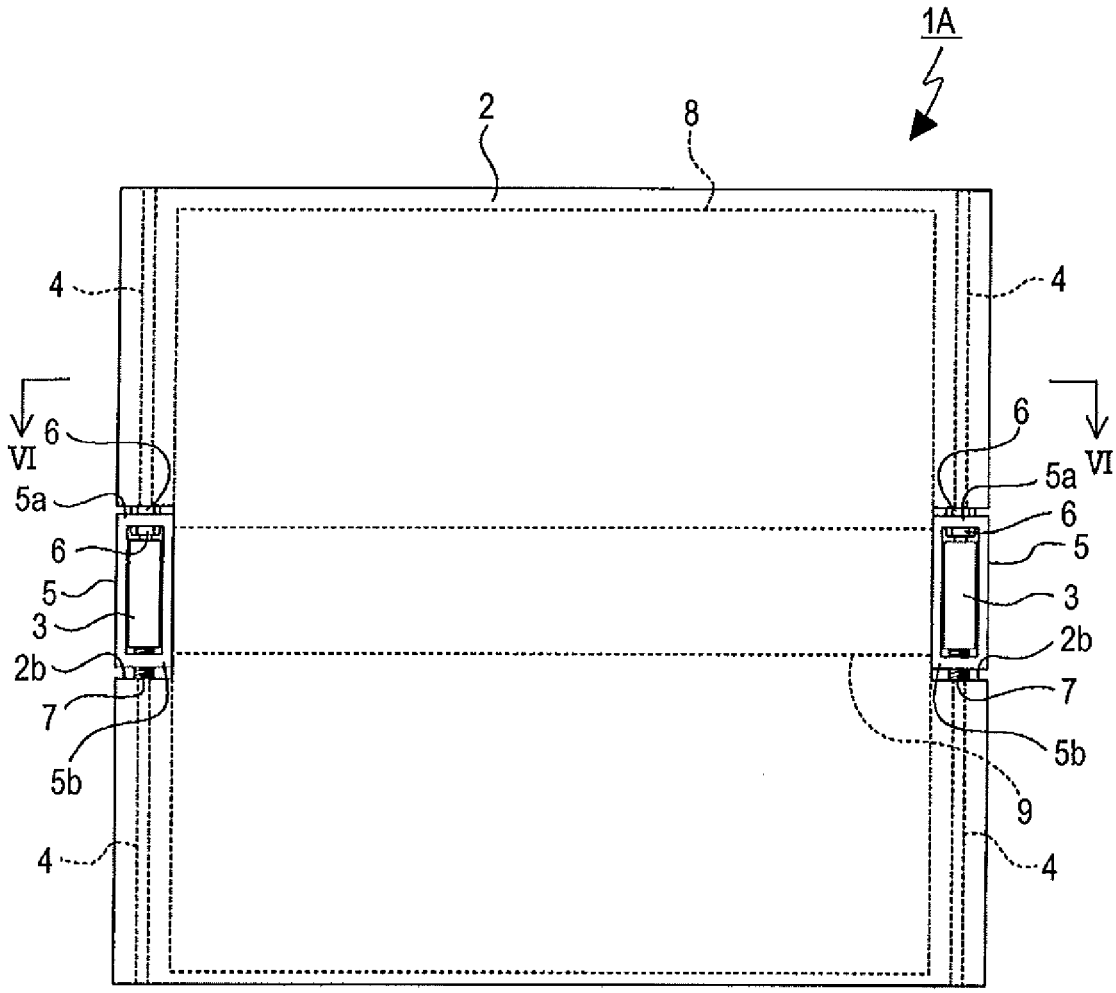
FIG. 5 is a front view of an exemplary speaker apparatus in which a display device is disposed between two diaphragms.
Figure 6:
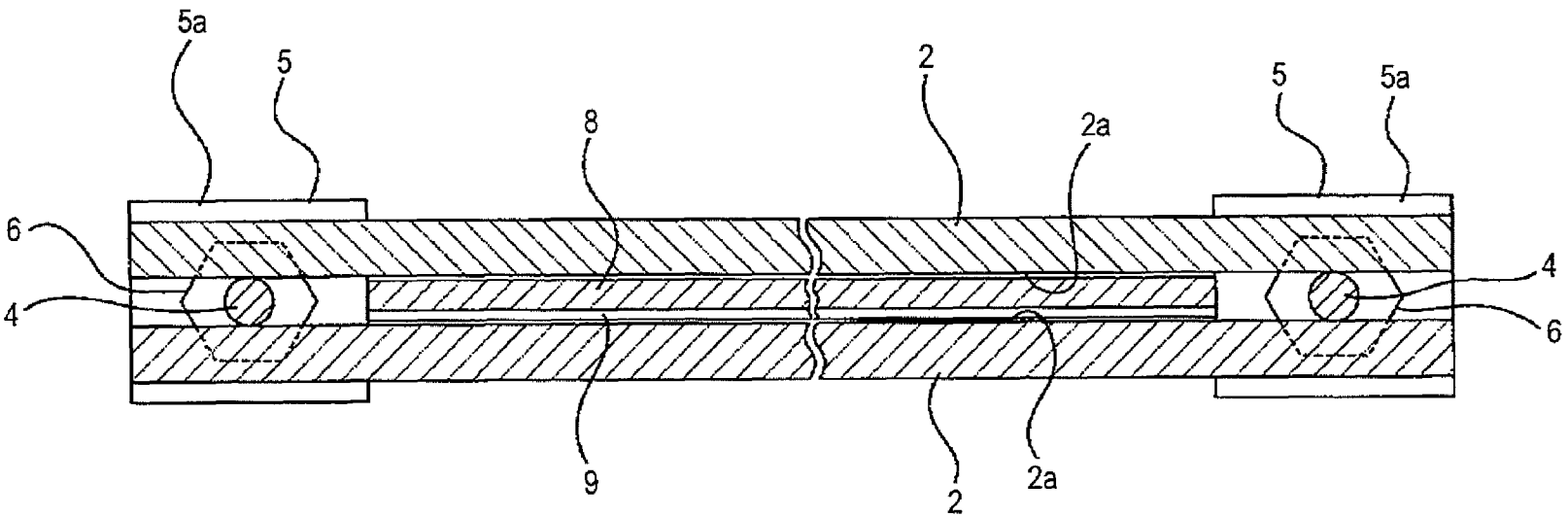
FIG. 6 is an enlarged sectional view of the speaker apparatus shown in FIG. 5 taken along the line VI-VI.

A speaker apparatus 1A includes two diaphragms 2 at least one of which disposed on the front side of the apparatus is formed from a transparent material, and a display device 8 or a light source device is disposed between the diaphragms 2 (see FIGS. 5 and 6). For example, an organic electroluminescence display, a liquid crystal display, or a plasma display may be used as the display device 8.

The display device 8 has a thickness smaller than the diameter of vibration transmitting members 4. For example, the diameter of the vibration transmitting members 4 is 1.5 mm, and the thickness of the display device 8 is less than 1.5 mm.

A sheet-like mount base 9 is provided between holders 5, and the display device 8 is mounted on a front surface of the mount base 9. A small gap is formed between a rear surface of the mount base 9 and the diaphragm 2 disposed on the rear side of the mount base, and a small gap is also formed between a front surface of the display device 8 and a rear surface of the diaphragm 2 disposed on the front side of the display device 8.

As thus described, the display device 8 is not in contact with the diaphragms 2, and the apparatus therefore has a configuration in which vibration transmitted to the diaphragms 2 has no influence on the output of an image on the display device 8 and in which the display device 8 has no influence on sounds output from the diaphragms 2.

As thus described, at least one of the diaphragms 2 of the speaker apparatus 1A is formed from a transparent material. Therefore, a device providing output other than sounds such as images and light rays can be disposed between the diaphragms 2, and the apparatus can be used in a wider variety of applications.

Sounds can be output along with a different type of output by disposing the display device 8 or a light source device between the diaphragms 2, and the apparatus can therefore be used as a display apparatus outputting images or an illumination apparatus outputting light.

When the display device 8 or a light source device is disposed between the diaphragms 2, the diaphragm 2 disposed on the rear side may be formed from a material that is not transparent. The material of the diaphragm 2 disposed on the rear side can be selected with a higher degree of freedom.

Figure 7:
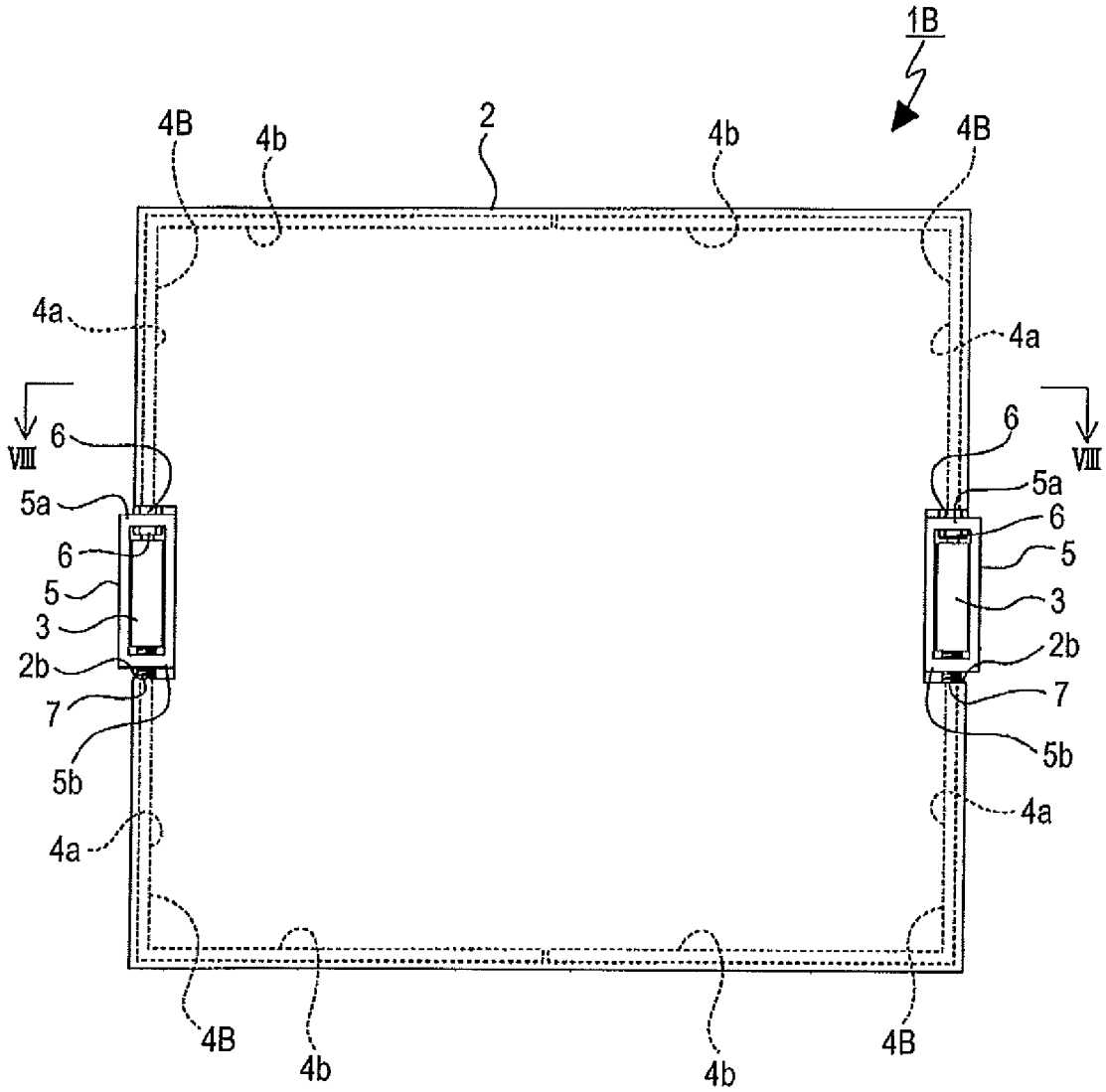
FIG. 7 is a front view of an exemplary speaker apparatus in which diaphragms are held by vibration transmitting members.
Figure 8:
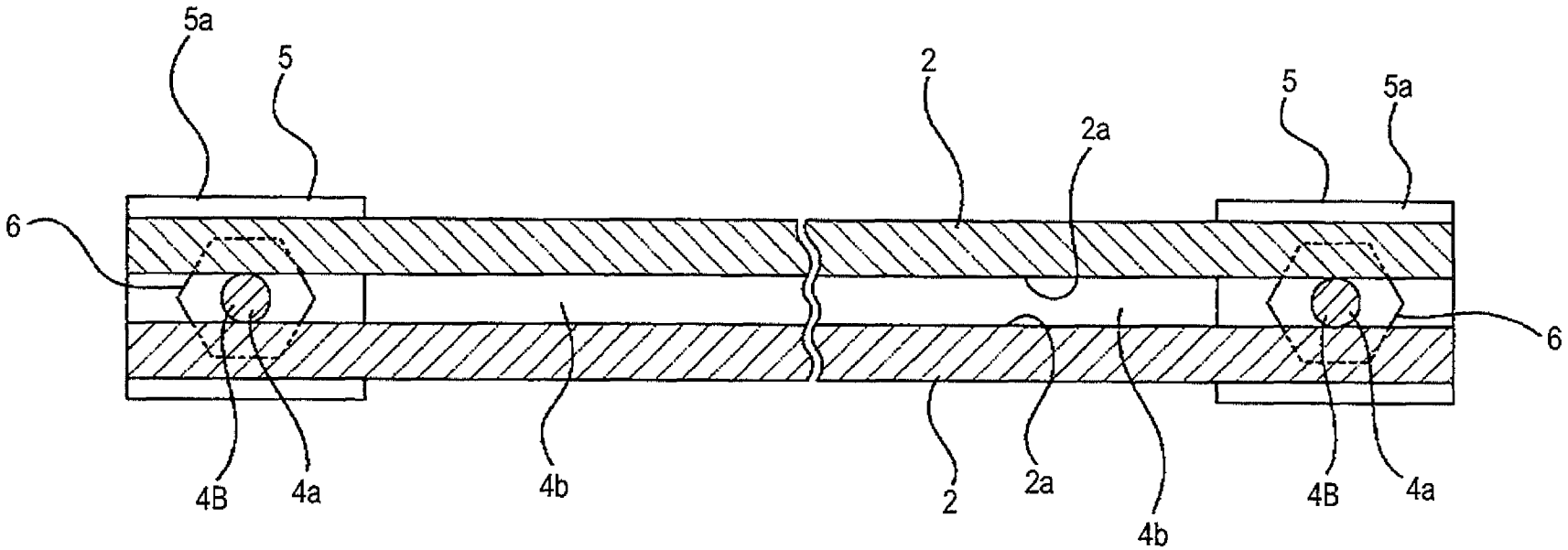
FIG. 8 is an enlarged sectional view of the speaker apparatus shown in FIG. 7 taken along the line VIII-VIII.

A speaker apparatus 1B includes vibration transmitting members 4B (see FIGS. 7 and 8).

The vibration transmitting members 4B include first portions 4*a* extending in the top-bottom direction and second portions 4*b* contiguous with ends of the first portions and extending in the left-right direction orthogonally to the first portions.

In the speaker apparatus 1B, the vibration transmitting members 4B are in the form of frames, and peripheral parts of diaphragms 2 are attached to the vibration transmitting members 4B.

As thus described, in the speaker apparatus 1B, peripheral parts of the diaphragms 2 are attached to the vibration transmitting members 4B having a frame-like overall shape, and the diaphragms 2 are thereby held by the vibration transmitting members 4B. Thus, the vibration transmitting members 4B function as holding means for holding the diaphragms 2.

Diaphragms 2 in the form of sheets having a thickness as small as, for example, about 0.1 mm can be used in the speaker apparatus 1B, and the apparatus can therefore be provided with a smaller thickness.

The second portions 4*b* located on the left and right sides in the vibration transmitting members 4B of the speaker apparatus 1B may be formed continuously instead of forming gaps between the second portions 4*b* as illustrated.

Vibration generated at actuators 3 is transmitted from the first portions 4*a* of the vibration transmitting members 4B to the second portions 4*b*. Since corners having an angle of 90° are defined between the first portions 4*a* and the second portions 4*b*, the vibration is attenuated at the corners, and the amplitude of the vibration transmitted to the second portions 4*b* is therefore smaller than the amplitude of the vibration at the first portions 4*a*. Vibration transmitted to the to the diaphragms 2 through the second portions 4*b* therefore has a small amplitude, and interference exerted by the vibration transmitted to the diaphragms 2 through the second portions 4*b* on the vibration transmitted to the diaphragms 2 through the first portions 4*a* has a small impact.

[Other Modifications]

While an embodiment employing piezoelectric actuators including a piezoelectric element as the actuators 3 has been described above, the present disclosure is not limited to the use of piezoelectric actuators as the actuators 3. For example, magnetostrictive actuators including a magnetostrictive element or electrodynamic actuators may be used as the actuators 3.

When magnetostrictive actuators are used as the actuators 3, the actuators 3 can be provided with a small size and high power. When eletrodynamic actuators are used as the actuators 3, the actuators 3 can be provided with high power at a low cost.

While an embodiment employing two actuators 3 has been described above, the present disclosure is not limited to the use of two actuators 3, and three or more actuators 3 may be provided. When three or more actuators 3 are provided, the actuators 3 may be disposed in any position of the peripheries of the diaphragms 2.

For example, when three actuators 3 are provided, the actuators 3 may be used for a left (L) channel, right (R) channel, and a center channel, respectively.

The specific shapes and structures of various parts of the embodiment described above are merely examples of implementation of the present disclosure, and it should not be considered that such shapes and structures are limiting the scope of the technique disclosed herein.

It should be understood by those skilled in the art that various modifications, combinations, sub-combinations and alterations may occur depending on design requirements and other factors insofar as they are within the scope of the appended claims or the equivalents thereof.

What is claimed is:

1. A speaker apparatus comprising:

an actuator serving as a source of vibration;

a vibration transmitting member connected to the actuator; and two sheet-like diaphragms provided opposite to each other in a thickness direction thereof with the vibration transmitting member interposed therebetween such that the vibration transmitting member contacts each of the two sheet-like diaphragms, the vibration transmitting member being configured and arranged to enable vibration from the actuator to be transmitted therethrough to each of the two diaphragms to output sounds.

2. A speaker apparatus comprising:

an actuator serving as a source of vibration;

a vibration transmitting member connected to the actuator; and two sheet-like diaphragms provided opposite to each other in the thickness direction thereof with the vibration transmitting member and disposed in contact with the vibration transmitting member, wherein vibration generated at the actuator is transmitted to each of the two diaphragms through the vibration transmitting member to output sounds, wherein the vibration transmitting member is a wire extending in a direction orthogonal to the thickness direction of the diaphragms; and each of the two diaphragms is in contact with a circumferential surface of the vibration transmitting member.

3. A speaker apparatus according to claim 2, wherein a peripheral part of each of the two diaphragms is in contact with the vibration transmitting member.

4. A speaker apparatus according to claim 3, further comprising a plurality of the actuators, wherein two actuators among the plurality of the actuators are disposed on two sides of the diaphragms.

5. A speaker apparatus according to claim 1, wherein the two diaphragms are formed from different materials.

6. A speaker apparatus according to claim 1, wherein the two diaphragms are formed with different thicknesses.

7. A speaker apparatus according to claim 1, wherein at least either of the two diaphragms is formed from a transparent material.

8. A speaker apparatus according to claim 7, wherein a display device displaying images or a light source device emitting light is disposed between the two diaphragms.

9. A speaker apparatus comprising:

an actuator serving as a source of vibration;

a vibration transmitting member connected to the actuator; and two sheet-like diaphragms provided opposite to each other in the thickness direction thereof with the vibration transmitting member and disposed in contact with the vibration transmitting member, wherein vibration generated at the actuator is transmitted to each of the two diaphragms through the vibration transmitting member to output sounds, wherein the vibration transmitting member is provided in the form of a frame extending along peripheral parts of the two diaphragms; and the two diaphragms are attached to the vibration transmitting member and held by the vibration transmitting member.

10. A speaker apparatus according to claim 1, wherein a piezoelectric actuator is used as the actuator.

11. A speaker apparatus according to claim 1, wherein a magnetostrictive actuator is used as the actuator.

12. A speaker apparatus according to claim 1, wherein an electrodynamic actuator is used as the actuator.

13. A speaker apparatus according to claim 1, in which the vibration transmitting member is a wire.

14. A speaker apparatus according to claim 1, in which wherein the vibration transmitting member is provided in the form of a frame extending along parts of the two diaphragms.

* * * * *